United States Patent [19]

Kracl

[11] 4,404,543

[45] Sep. 13, 1983

[54] DOWN MARKER INDICATOR FOR FOOTBALL COMPETITION

[76] Inventor: David L. Kracl, 14406 Tiburon Rd., San Leandro, Calif. 94577

[21] Appl. No.: 289,480

[22] Filed: Aug. 3, 1981

[51] Int. Cl.[3] ..... G08B 23/00; A63B 71/06

[52] U.S. Cl. ..... 340/323 R; 116/222; 116/223; 116/225; 116/281; 116/299; 116/309; 116/315; 116/321; 116/324; 40/486; 40/502; 340/321

[58] Field of Search ..... 340/321, 323 R; 273/1 ES, 55 R; 40/486–488, 502; 116/222–225, 281, 283–286, 299, 306, 309, 321, 324, 310, 312

[56] References Cited

U.S. PATENT DOCUMENTS

| | | | |
|---|---|---|---|
| 2,064,745 | 12/1936 | Harrie | 116/225 |
| 2,208,009 | 7/1940 | Rosenboom et al. | 116/222 |
| 2,517,239 | 8/1950 | Rickabaugh | 340/323 R |
| 2,549,627 | 4/1951 | Musch et al. | 340/323 R |
| 3,728,708 | 4/1973 | Culbertson | 340/323 R |
| 3,868,671 | 2/1975 | Maguire et al. | 340/323 R |
| 3,985,356 | 10/1976 | Carlock | 273/55 R |

*Primary Examiner*—James J. Groody

[57] ABSTRACT

An improved indicia display apparatus particularly useful for displaying indicia indicating the number of down to be played in football competition and locating the position of the ball along the sideline, for example, the apparatus comprising an opaque outer cylinder with a domed top and bottom, with three evenly spaced openings, said outer cylinder fitting over a translucent inner cylinder with two rows of printed indicia. Illumination within the inner cylinder is attached to a center pole that attaches to the domed top of the outer cylinder by a male and female plastic threaded screw fittings. The inner cylinder having a sleeve that slides up and down and rotates on the center pole for selecting desired indicia representing chosen down. Top dome and bottom dome of the outer cylinder are attached to outer cylinder body with metal screws for securing assembly together and removing to replace illuminating device.

2 Claims, 4 Drawing Figures

DOWN MARKER INDICATOR FOR FOOTBALL COMPETITION

FIELD OF INVENTION

This invention relates to an improved down marker indicator and specifically to a down marker which is cylindrical in shape and visible from all directions. Down indicia is printed on a cylinder to indicate the number of downs to be played or the down in progress and the position of the ball in relation to the side line. Three numbers, evenly spaced 120 degrees apart, are visible in a 360 degree circumference each time a preselected indicia is chosen to indicate correct down. Said marker is mounted on a vertical axis, meaning a center pole, which is tall enough in height to be seen over operator, players and spectators. In addition to said down marker indicator function, several auxiliary aides are added to assist officials in officiating the game and making said down indicia more visible during night games.

DISCUSSION OF PRIOR ART

Heretofore, in a football game, the position of the ball and the number representing the down to be played or being played was shown by a set of indicia printed on metal plates. These said plates are mounted on a vertical pole high enough not to obstruct the viewing of said indicia by players in the field, the individual operating apparatus and spectators near-by. The bottom tip of said pole is used to mark the position of the ball's progress in relation of the side line. Traditionally, the individual operating said apparatus, in order to change down indicia, would have to lean said pole over and flip the plates showing preselected down indicia, being visible from only the front and rear and not the sides of said apparatus. When the traditional down marker was moved from one position to another position on the side line after each successive down or at the end of the quarter, officials had no recollection of the prior position of the ball. Also, due to the flatness and sharp edges of the sheets the down indicia are printed on and the rigidness of the metal pole on which said indicia is mounted, said apparatus becomes a safety hazard when contact is made by players running into said down marker indicators.

OBJECTS

Accordingly, several objects of my invention are that the down indicia are printed on a cylinder with numerical indicia spaced 120 degrees apart, making indicia visible in a 360 degree circumference, which is light weight, durable and warm to the touch. It is a further object of the present invention to make said apparatus safer with no sharp, flat edges or corners. Said apparatus is also mounted on a flexible central vertical axis substantially reducing the chances of injury on contact.

It is a further objective of the present invention to aid officials in locating previous positions of the ball by using a two number movable digital counter on the base of said outer cylinder, which has two sets of digits mounted on separate dials that are moveable to select and record prior yard line position of football with the side line. Each time a new position of down marker indicator is selected, a new yard line indicia is selected by operator on digital dials.

It is yet a further object of the present invention to make said indicia down numbers more visible at night or during dark, overcast days by having electric light bulbs mounted inside the cylinder behind transparent numbers, supplied by an electrical rechargeable storage battery carried by operator.

Further objects and advantages of my invention will become apparent from a consideration of the drawings and ensuing discription thereof.

DRAWINGS

DESCRIPTION

Figure 1:
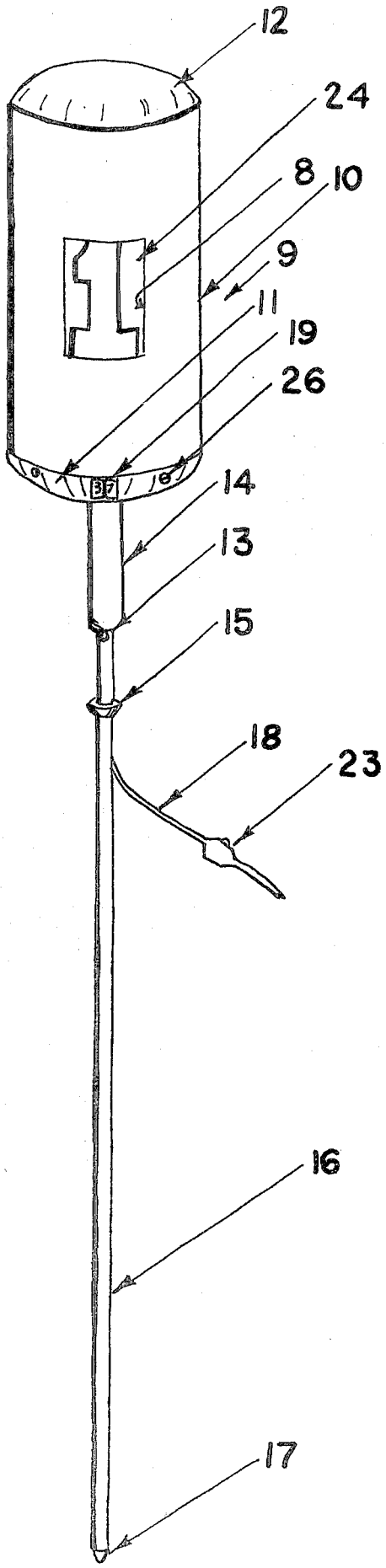
FIG. 1 is a perspective side view of the improved down marker indicator.
Figure 2:
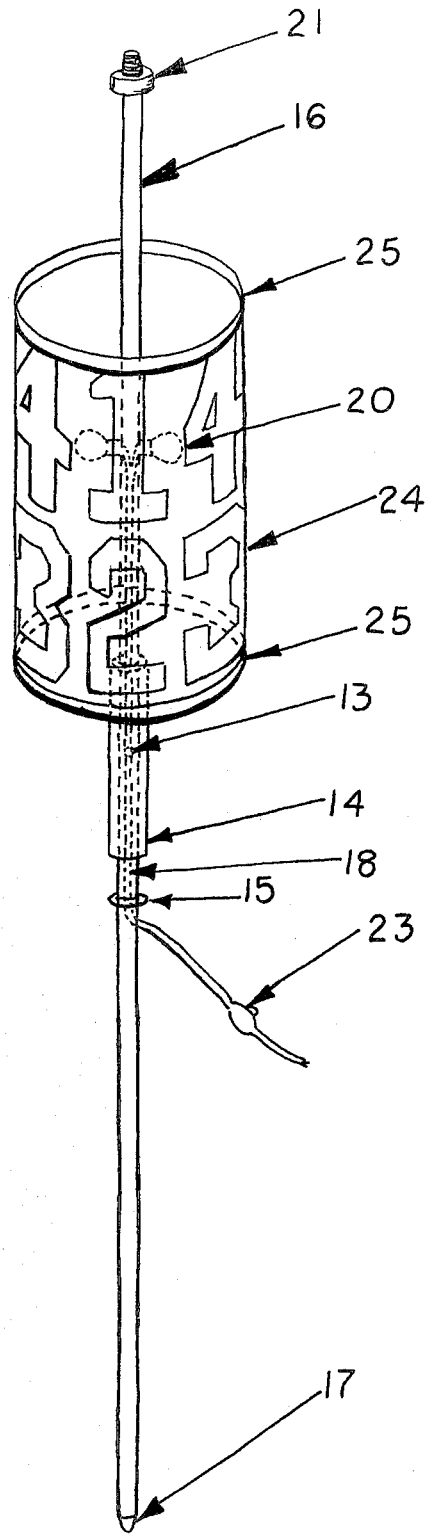
FIG. 2 is a exploded view without the outer cylinder and its top and bottom.
Figure 4:
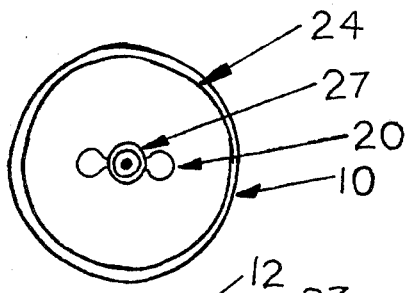
FIG. 4 is a top view, without the top of outer cylinder illustrating both cylinders, center pole and mounted lights.
Figure 3:
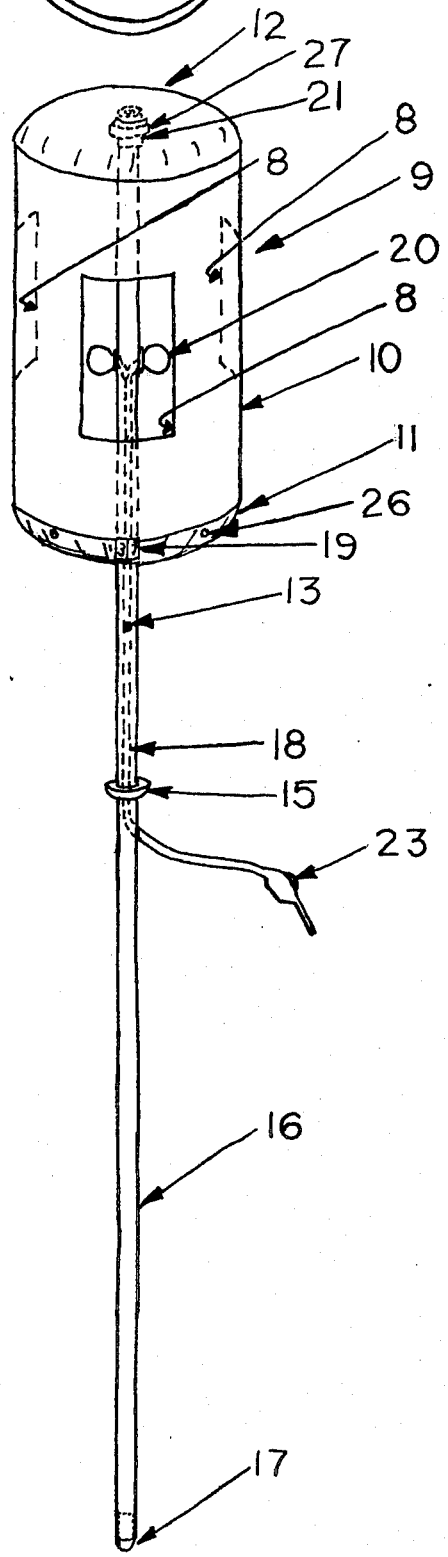
FIG. 3 is a side view without the inner cylinder and sleeve.

The apparatus of the present invention, the football down marker indicator, generally designated 9 includes an inner cylinder 24 with three view openings 8, and outer cylinder 10 with a top dome 12, a bottom dome 11, both cylinders 24 10 mounted on a vertical axis, meaning a center pole 16 by a sleeve 14, the outer cylinder 10 is attached to the top of the center pole 16 with a male threaded fitting 21 into a female threaded fitting 27 on the inside of the top dome 12. A stop 15 mounted on the center pole 16 limits the downward movement of the inner cylinder 24, a release pushbutton 13 is used to hold said inner cylinder 24 in the up position. A two digital, moveable counter 19 is secured to the bottom dome 11 of outer cylinder 10 by adhesive. Top dome 12 of outer cylinder 19 is secured also by means of adhesiver, where as, bottom dome 11 is attached by means of metal screws 26 for easy dis-assembly of apparatus. Electric light bulbs with sockets 20 are attached to the center pole 16 by "pop rivets" directly behind the viewing openings 8 of the outer cylinder 10. An electrical cord 18 with a switch 23 travels down the inside of center pole 16 exiting half-way down to a re-chargeable battery pack carried by operator. Bands 25 on the outside of the inner cylinder 24 at the top and bottom attached by "pop rivets" are used as spacers to keep a surface of inner cylinder 24 from contacting inside surface of outer cylinder 10 with the three viewing openings 8.

A tip 17 on the bottom of the center pole 16 is used to mark the position of the ball on the field with relation to the side line.

The materials for construction of the outer cylinder 10, top dome 12, bottom dome 11, are preferrably ABS plastic with a thickness of 0.090 inches. Material for the inner cylinder 24 preferrably is translucent fiberglass with a thickness between 0.030 and 0.060 inches. Center pole 16 and sleeve 14 are made from 1¼ and 1½ P.V.C. plastic pipe with P.V.C. male 21 and female 27 threaded fittings. The tip ofthe center pole 17 is solid, clear plastic. The electric light bulbs and sockets 20 are 12 volt, used on electric circuits of an automobile, with 18 gauge electrical cord 18 and a rotary "on-off" light switch 23 used on 120 volt house circuits. The digital counter 19 is made of plastic with two rotary, moveable dials with numbers used for various counting devices. Screws 26 securing bottom cap 11 to the outer cylinder 10 are small sheet metal screws. Attaching the light bulb sockets to center pole, "pop rivets" were used with good results.

OPERATION

Essentially, the apparatus of the present invention includes a vertical axis, meaning a center pole with a rounded plastic tip on the bottom and a male threaded fitting on the top. Sliding over the center pole is a inner cylinder with a base and sleeve, having two rows of numerical down indicia representing the downs used in football competition. The center pole has a bottom collar that prevents the sleeve of the inner cylinder in the up position on said vertical axis.

To conceal all but three of the same preselected down indicia from view, an outer cylinder with a dome shaped top and bottom is attached to the center pole by male and female threaded fittings inside the top dome. Said outer cylinder acts as a shield permitting the viewing of one pre-selected indicia in three positions, spaced 120 degrees apart on the circumference of said outer cylinder. Selection of pre-selected down indicia is by rotating sleeve of inner cylinder right or left or moving said sleeve up or down until desired down indicia is positioned in the three view openings spaced around the outer cylinder.

Once the down marker is positioned on the side line to mark the progress of the ball in relation to the side line, the operator selects, on the two digital dials of the yard line indicator, the yard line numbers that correspond to the position of the ball on the field by turning each dial. These digits remain the same until after the down marker is moved to another position and the down indicated on the down marker is in progress.

To illuminate the down indicia more during night games or on overcast day games, a 12 volt, re-chargeable, battery pack is carried by the operator and attached to the down marker apparatus by an electrical cord with an "on-off" switch attached in the cord. Two 12 volt electric light bulbs are mounted on the center pole directly behind the viewing opening of the outer cylinder.

BROADENING PARAGRAPHS

While the above description contains many specificities, these should not be construed as limitations on the scope of the invention, but rather as an exemplification of one preferred embodiment thereof. Many other variations are possible, for example, in place of numerical indicia on inner cylinder representing the downs of football, numerical indicia can be replaced with various inner cylinders with lettering of team logo, names, or printed messages. Accordingly, the scope of the invention should be determined not by the embodiment illustrated, but by the appended claims and their legal equivalents.

I claim:

1. Down marker indicator for use with football sideline chains and comprising, in combination:

(a) an inner cylinder, with a sleeve that rotates or moves up and down on a vertical axis, numerical down indicia printed on the outer surface of said cylinder, (b) an outer cylinder having a dome top and bottom, three evenly spaced viewing openings around the outer circumference of the outer cylinder for viewing said numerical down indicia, (c) a vertical axis center pole having a rounded tip at its base, said center pole attached to the outer cylinder dome top by means of male and female thread fittings and including a collar and push button release means for positioning said outer cylinder, (d) means for illuminating said down marker indicator, switch means connecting said illuminating means to an external portable power source means for energizing said illuminating means, (e) said outer cylinder further including two movable dials with numerical indicia printed thereon attached to the circumferential edge of the dome bottom.

2. The down marker indicator as defined in claim 1 wherein said inner cylinder is fabricated from translucent fiberglass and said center pole, threaded fittings, outer cylinder including dome top and bottom are made of plastic.

* * * * *